US008894309B2

(12) United States Patent
Geuther et al.

(10) Patent No.: US 8,894,309 B2
(45) Date of Patent: Nov. 25, 2014

(54) COSMETICS UNIT WITH DUAL ARM APPLICATOR

(75) Inventors: Manuela Geuther, Ansbach (DE); Friedrich Weigel, Wittelshofen (DE)

(73) Assignee: Geka GmbH, Bechhofen (DE)

( * ) Notice: Subject to any disclaimer, the term of this patent is extended or adjusted under 35 U.S.C. 154(b) by 367 days.

(21) Appl. No.: 13/461,340

(22) Filed: May 1, 2012

(65) Prior Publication Data

US 2012/0282008 A1 Nov. 8, 2012

(30) Foreign Application Priority Data

May 3, 2011 (DE) ..... 10 2011 100 302

(51) Int. Cl.
*A46B 11/00* (2006.01)
*A45D 40/26* (2006.01)

(52) U.S. Cl.
CPC ..... *A45D 40/26* (2013.01); *A45D 40/267* (2013.01); *A45D 40/262* (2013.01)
USPC ..... 401/126; 132/218; 401/129

(58) Field of Classification Search
USPC ..... 401/126, 129; 132/216, 218
See application file for complete search history.

(56) References Cited

U.S. PATENT DOCUMENTS

| | | | | |
|---|---|---|---|---|
| 5,007,442 | A | 4/1991 | Hirzel | |
| 5,052,839 | A * | 10/1991 | Pettengill | 401/126 |
| 2012/0282009 | A1 * | 11/2012 | Geuther | 401/126 |
| 2013/0004227 | A1 * | 1/2013 | Geuther et al. | 401/122 |

FOREIGN PATENT DOCUMENTS

| | | | |
|---|---|---|---|
| DE | 29609340 | U1 | 8/1996 |
| DE | 19848472 | A1 | 4/2000 |
| WO | 2004077987 | A1 | 9/2004 |

* cited by examiner

*Primary Examiner* — David Walczak
*Assistant Examiner* — Jennifer C Chiang
(74) *Attorney, Agent, or Firm* — Setter Roche LLP

(57) ABSTRACT

A cosmetics unit comprising a storage container and an applicator with two applicator arms, wherein each applicator arm carries one applicator element and the two arms are interconnected by a spring member, wherein the applicator has a bipartite applicator-side closure member for closing the cosmetics container, whose one part is a component of the one applicator arm and whose other part is a component of the other applicator arm, wherein the closure member has a bipartite threaded portion, the one threaded-portion part of which is formed on the one part of the closure member, and the other threaded-portion part of which is formed on the other part of the closure member, and with which the closure member can be screwed on to a container-side closure member.

20 Claims, 8 Drawing Sheets

COSMETICS UNIT WITH DUAL ARM APPLICATOR

FIELD OF THE INVENTION

The invention relates to a cosmetics unit.

BACKGROUND OF THE INVENTION

An essential component of the cosmetics unit according to the invention is a cosmetics applicator with two applicator arms which respectively carry one applicator element. In the broadest sense, the cosmetics applicator thus has the functional capability of a pair of pincers. Due to this fact, it is hereinafter referred to as "dual arm applicator" in short.

Dual arm applicators for applying a cosmetic are known per se. However, the dual arm applicators known so far are configured in many cases as a separate tool which is taken in hand if needed, is dipped into the cosmetic and used for application, but which has to be stored separately of the storage container for the cosmetics, after using it (for said storage container hereinafter sometimes the word "cosmetics container" will be used that has the same meaning). This is very impractical, since such dual arm applicators have to be cleaned after application because the cosmetic adhering to them dries up otherwise, so that the application behavior of the dual arm applicator deteriorates and becomes more unhygienic with every use, see for example U.S. Pat. No. 5,176,156.

In view of this, dual arm applicators have also been proposed already which are stored dipped into the cosmetics container between two applications. As is necessary, such dual arm applicators in that case form a closure member for the cosmetics container at the same time in order to close off the neck opening of the cosmetics container through which they are pushed.

Such a dual arm applicator, which may also be referred to as a pincer applicator, is known, for example, from WO 2004/077987 A1 and the U.S. Pat. No. 5,007,442.

The pincer applicator of this last document forms a closure member which in the broadest sense functionally matches a cork. This closure member has a smooth outer circumference adapted to the internal diameter of the neck of the cosmetics container in such a way that the closure member can be inserted into the neck of the cosmetics container with a certain bias, remains there by frictional fit and seals the neck.

The problem in this case is that the required leak protection of the cosmetics container cannot be ensured in all cases with such a closure member, particularly not in those cases in which a certain carelessness must be expected when the cosmetics container is closed again using the dual arm applicator. This is due to the fact that the frictional fit between the closure member and the bottle neck may come undone under unfavorable circumstances. This possibility exists not least because the cosmetics containers are typically used not only stationarily in the bathroom at home, but are also intended for use on the move, which is why they are in part transported loose in handbags over long periods of time.

In view of this, it is the object of the invention to provide a cosmetics unit with a dual arm applicator which is capable of securely closing in a simple manner the cosmetics container that serves for storing it.

SUMMARY OF THE INVENTION

According to the invention, a cosmetics unit with a storage container and a cosmetics applicator is provided which comprises two applicator arms that extend next to one another in the direction pointing inside the container (relative to the cosmetics unit). Both applicator arms each carry one applicator element in the form of a brush or a comb or the like. In this case, the two applicator arms are interconnected preferably by a spring member injection-molded on to them. At the same time, the mascara applicator has a bipartite applicator-side closure member for closing the cosmetics container. The one part of this closure member is an integral or attached component of the one applicator arm, whereas the other part of the closure member is an integral or attached component of the other applicator arm. The two-part applicator-side closure member thus formed is provided with a threaded portion and, with that, can be screwed on to a container-side closure member that is an integral or attached component of the cosmetics container. For this purpose, the closure member has a bipartite threaded portion, the one threaded-portion part of which is formed on the one part of the closure member, and the other threaded-portion part of which is formed on the other part of the closure member. In this way, the cosmetics container can be closed very easily and nevertheless reliably by the dual arm applicator.

The advantage in this case is that inadvertent detachment of the two-part applicator from its closing position in the container neck is almost impossible. On the other hand, the advantage is that a quite exactly defined sealing pressure can be very easily generated by screwing such an applicator on to the cosmetics container, i.e. a pressure with which, for example, a portion of the applicator intended for sealing can be pressed onto the cosmetics container against a seal or in particular against the collar of the wiper, which has a sealing action. Such a type of sealing is more reliable already due to the fact that it is considerably less sensitive to dirt that has formed in the area of the seal due to the cosmetic mass that has settled there and that has then dried up.

Preferably, each part of the closure member in this case carries only a single thread. Ideally, each of these single threads has a pitch of at least 1.2 mm, better at least 1.5 mm, and ideally, at least 1.7 mm. Only one thread per part of the closure member with, preferably, a large pitch (i.e. a pitch in the above-mentioned size range) ensures that the threaded portion works without locking and jamming even without particular care being taken by the user, even though it is formed on two different parts which are only loosely connected and which, at the beginning of the screwing-on process, will definitely have a certain offset relative to one another from time to time until they are forced by the threaded portion according to the invention into a position that is precisely aligned relative to one another.

Within the context of a preferred embodiment, it is provided that the threaded portion is a double-start threaded portion, whose one thread is formed entirely on one part of the applicator-side closure member and whose other thread is formed entirely on another part of the applicator-side closure member.

A double-start threaded portion configured in this way not only facilitates the screwing-on process, but above all ensures that each of the two parts of the applicator-side closure member participates steadily in closing the container neck. In addition, such a threaded portion contributes to improving the centering effect of the loosely interconnected parts already mentioned above.

Within the context of another preferred embodiment it is provided that the threaded portion is a steep-pitch threaded portion with a thread lead of $\gamma \geq 5°$ and preferably $\gamma \geq 7.5°$. The use of such a steep-pitch threaded portion leads to a tight closure of the container neck being accomplished already with less than a full turn of the cosmetics applicator. Moreover, the relative movement between the applicator and the wiper or parts of the wiper required for closing is greatly reduced, which is a great advantage particularly in such a dual arm applicator. This is the case particularly if a wiper with a so-called dividing wall is used.

On the other hand, the advantage is that a quite exactly defined sealing pressure can be very easily generated by screwing on such an applicator, i.e. a pressure with which, for example, a portion of the applicator intended for sealing is pressed against a seal or in particular against the collar of the wiper that has a sealing action. In this case, the steep-pitch threaded portion is preferably designed in such a way that inadvertent detachment of the two-part applicator from its closing position in the container neck is almost impossible.

Preferably, the two applicator arms are interconnected by a spring member, which is most frequently configured in the form of a leaf-spring member. At its distal end, i.e. the end facing away from the actual applicator, this comprises an annular spring member. Spring portions that are concavely curved towards the outside are integrally adjacent to this annular spring member. Their opposing, generally convex inner faces preferably rest against each other and then limit the further deformation of the annular spring member once the two applicator arms have come to rest against each other when the applicator is compressed.

Such a spring member ensures a very exact guidance of the two applicator arms relative to one another, i.e. the applicators meet each other neatly when the applicator arms are compressed, even if the user does not take particular care when compressing them. Moreover, such a spring member opposes the action of compressing the applicator arms with a noticeable spring action, which improves the handling of the applicator. This is due to the fact that the two applicator arms of the spring member are pressed apart right away once the pressure on the two applicator arms is taken away, even if the cosmetic mass, which has a not inconsiderable adhesive action, tends to hold the two applicators in the position in which they rest against each other. Finally, such a configuration of the spring member ensures that it or its annular section is not overloaded when the two applicator arms are compressed completely, not even when the pressure on the spring member is not taken away although the two applicator arms already rest against each other.

In this case, the wall thickness and/or the width of the leaf spring member are preferably constant. A "constancy" is substantially provided if the variation of the wall thickness or of the width is not greater than ±20%. Preferably, the variation is actually not greater than 5%.

In this case, the width of the spring member, at least in the area of its annular spring member, is preferably greater than or identical to the diameter of the access opening or of the neck of the cosmetics container.

Ideally, the bipartite applicator-side closure member is an integral component of the spring member.

Expediently, each part of the bipartite applicator-side closure member has an accommodating portion or an appendage for the positive attachment of the respective applicator arm.

Preferably, the cosmetics unit according to the invention comprises a wiper which has a substantially sleeve-shaped wiper body for mounting in a preferably circular container. In this case, the passage for the cosmetics applicator formed inside the wiper body is divided, at least in some areas, by a dividing wall into two passage portions extending next to one another. Each of the passage portions accommodates one applicator arm.

A wiper configured in this way is able to cleanly wipe off each of the two applicator arms. No appreciable amount of cosmetic mass remains on the two side surfaces of the applicator arm, which face each other and which, when the applicator is fully compressed, possibly rest against each other completely or in some areas. Thus, a better wiping result clearly can therefore be obtained than with one of the conventional wipers which are able to wipe off the two applicator arms only along their outer circumference, but not in the area of their contact surfaces of the opposing side surfaces.

Within the context of another preferred embodiment, it is provided that the wiper is dimensioned in such a way, and comprises at least one latching element by which it can be fixed in the direction of the longitudinal axis on a cosmetics container in such a way, that it is able to follow the rotary movement of the cosmetics applicator when the cosmetics unit is screwed open or shut, and that it remains on the cosmetics container when the cosmetics applicator is withdrawn. Such a configuration is advantageous in that the wiper is retained firmly on the bottle neck of the cosmetics container in the longitudinal direction. At the same time, however, the wiper is movable in the circumferential direction relative to the bottle neck, in its entirety, even if it does not consist of two parts, of which one can be moved relative to the other. Such a configuration offers the great advantage that a one-piece chambered wiper can be used, which co-rotates with the dual arm applicator when it is screwed shut.

In this case, the dual arm applicator (or the parts of it that form the applicator-side closure member) and the collar of the wiper are designed in such a way that the applicator-side closure member exerts considerable pressure on the collar of the wiper in the final phase of the screwing-on process. Thus, the latter is, on the one hand, pressed against a correspondingly designed surface on the end face of the bottle neck, at least if it is insufficiently soft, and on the other hand against the applicator-side closure member. Due to this fact, the collar of the wiper can be clamped between the applicator-side closure member and the bottle neck in such a way that it seals in a liquid-tight manner.

In this case, the collar is expediently made from a rubber-elastic material, or it bears a rubber-elastic coating at least in the area of its sealing surfaces. Alternatively, the wiper can also bear a loose rubber-elastic seal that is placed on the wiper in such a way that, if mounted as intended, it lies between the collar and the cosmetics container against which the collar abuts. This seal is then clamped and thus seals the collar against the corresponding seat or area on the cosmetics container.

Within the context of another preferred embodiment, it is provided that the wiper body comprises a first part which is rotatably retained on a second part of the wiper body. In this case, the first part is configured in such a way that it can be fixed on the cosmetics container as intended.

The second part of the wiper comprises the wiper lip and said dividing wall which divides the passage offered by the second part of the cosmetics applicator into two passage portions extending next to one another. In this case, the second part of the wiper body is rotatably attached to the first fixed part of the wiper body, preferably by latching.

This makes a wiper available whose first part seals against the container neck very reliably, because no relative movement whatsoever has to occur between the first part of the wiper and the container neck, and no sealing pressure has to be applied time and again, either. Nevertheless, this wiper, despite its dividing wall that divides it into two chambers, enables the use of a dual arm applicator that is screwed on to the cosmetics container and which rotates about its axis in the process, because the second part of the wiper, in which the dividing wall is also disposed, is able to rotate together with the dual arm applicator during the screwing-on process.

Further effects, advantages and optional embodiments become apparent from the following description of two exemplary embodiments and their variants with reference to the Figures listed below.

DETAILED DESCRIPTION OF THE PREFERRED EMBODIMENTS

Figure 1:
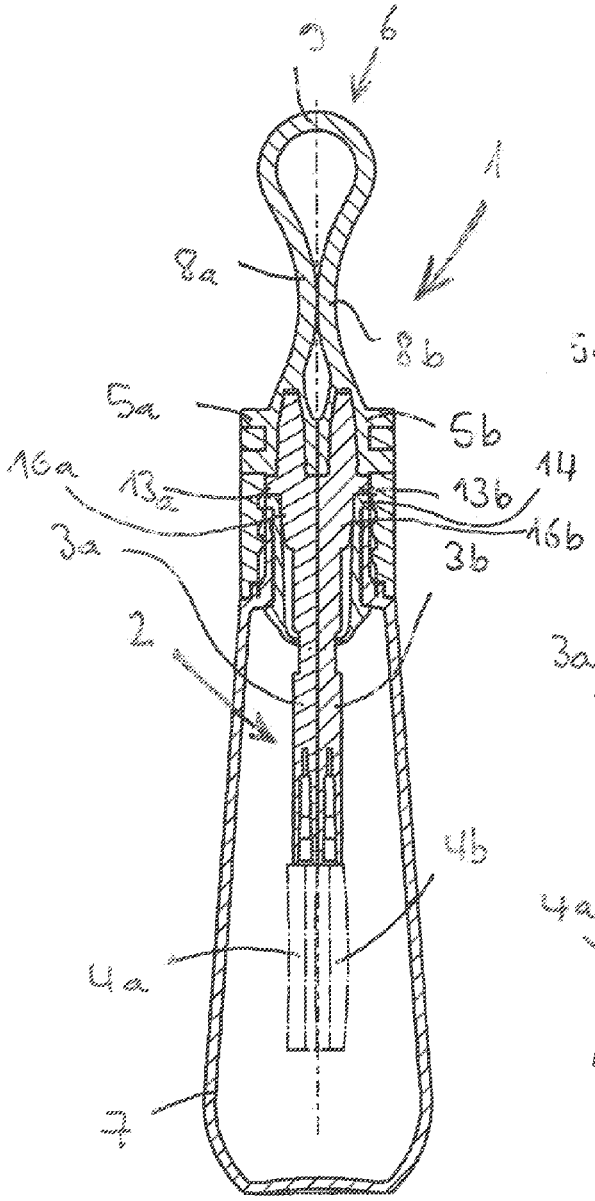
FIG. 1 shows a section along the longitudinal axis through a first exemplary embodiment of the cosmetics unit according to the invention.

FIG. 1 shows said first exemplary embodiment of the cosmetics unit according to the invention which is preferably a cosmetics unit which theoretically can also be configured as a cosmetics unit for coloring hair strands. This is a pincer applicator.

As will be explained in more detail below, this pincer applicator is configured as a so-called screw-on applicator, i.e. as an applicator which itself serves as a screw-on closure for the cosmetics container.

As can be seen quite well in this sectional drawing of the cosmetics unit, the cosmetics applicator is equipped with two applicator arms 3*a*, 3*b*. Each of the applicator arms, starting from a closure member formed by a first part 5*a* and a second part 5*b*, extends into the direction pointing inside the container, also see FIG. 2. The two said parts, namely the first and the second part of the closure member, are interconnected by an inventive spring member 6 which will be described in more detail later. Thus, the two applicator arms are not interconnected somewhere in their central area, but at their outermost proximal end, in a hinged manner. Thus, they have the functional capability of a pair of pincers that can be operated with two fingers.

The distal end of the applicator arms 3*a*, 3*b* facing away from the handle side is respectively equipped with an applicator element 4*a*, 4*b*. These applicator elements 4*a*, 4*b*, in the case described herein as an exemplary embodiment, respectively are a cosmetics brush or a comb.

Figure 2:
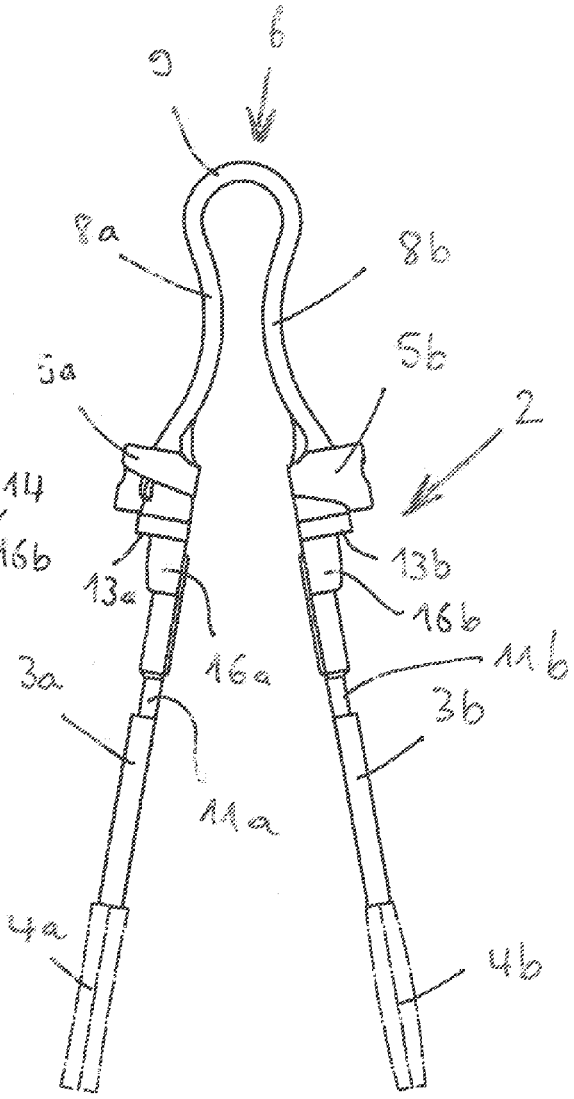
FIG. 2 shows the dual arm cosmetics applicator which can already be seen in FIG. 1 depicted on its own.

As can be seen in FIG. 2, the two application elements 4*a*, 4*b*, which in this case are both configured as cosmetics brushes covered with bristles that protrude in the radial direction all around, come to rest against each other or into engagement with each other when the two applicator arms assume their position of being fully pressed against each other. Due to this fact, the applicator elements are preferably configured with injection-molded bristles. This is advantageous because in the case of injection-molded bristles, the position, length and orientation of each individual bristle can be predefined exactly. It is thus rather simple to ensure that cosmetics brushes come to rest against each other or come into engagement with each other in a defined manner. Nevertheless, cosmetics brushes with a twisted wire core may also be used alternatively. Moreover, there may be cases in which it is advantageous to equip only one applicator arm with a cosmetics brush and the other applicator arm with a comb or the like instead.

After all this, it is clear that the cosmetics applicator functionally forms a tool that is reminiscent of a pair of pincers. Therefore, it may also be referred to as a pincer applicator for grasping eyelashes or hairs.

According to the FIGS. 1 and 2, the applicator arms 3*a* and 3*b* are preferably configured in such a way that whenever they fully rest against each other, they join to form a rod with a preferably circular cross section. Therefore, each of the applicator arms individually has a cross section which is substantially semi-circular. The rectilinear flanks of these semi-circular cross sections come to rest against each other.

According to FIGS. 1 and 2, each of the two applicator arms 3*a*, 3*b* comprises a so-called wiper relieving section 11*a*, 11*b*. The latter is configured as a recess in the respective applicator arm in which the wiper lip can come to rest with a reduced bias when the applicator has reached its final rest position relative to the cosmetics container 7.

The two parts 5*a*, and 5*b*, which together form the applicator-side closure member, are configured in a similarly bipartite manner as the applicator arms. If these two parts 5*a* and 5*b* rest against each other, they form an applicator-side closure member with a circular cross section. This closure member is equipped on its circumference with a threaded portion to be explained in more detail later, which can be screwed into a corresponding mating threaded portion of a container-side closure member in order to fix the applicator on the cosmetics container and at the same time securely close the cosmetics container.

Each of the two parts 5*a* and 5*b* forming the applicator-side closure member can be injection-molded integrally together with the applicator arm 3*a* or 3*b* associated with it. However, in a number of cases it is functionally correct to provide a multi-part design here, as in this first exemplary embodiment. A multi-part design offers the advantage, for example, that a less elastic plastic can be used for the applicator arms than for the parts of the applicator-side closure member, in particular if the latter is produced integrally with the spring member 6.

Even if all components are fabricated from one and the same plastic, which is to be preferred for very inexpensive disposable applicators in any case, said multi-part design offers advantages because it reduces tool costs—a multi-legged applicator that, as in this case, has to be injection-molded in a clearly opened position (see FIG. 2) requires a relatively large and thus expensive tool if it is to be injection-molded in a single piece with its arms 3*a* and 3*b* standing out far and widely apart.

Figure 11:
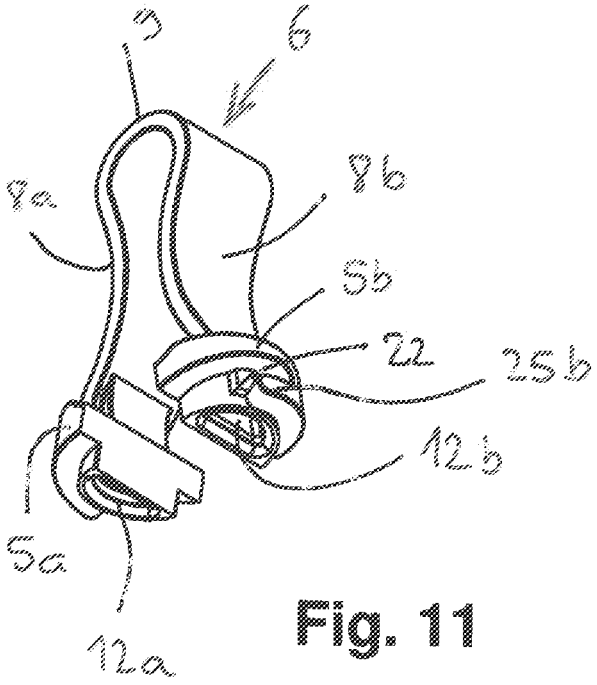

As can best be seen in FIG. 11 and FIG. 1, each of the two parts 5*a* and 5*b* of the applicator-side closure member is provided with a plug-in opening 12*a* or 12*b* for attaching the respective applicator arm 3*a* or 3*b*. Ideally, the plug-in openings and the plug-in shafts of the applicator arms corresponding therewith are configured in such a way that a latch in a positive fit can take place between the two parts simply by plugging them together. The plug-in openings penetrate the parts of the applicator-side closure member in the area in which they carry on their outer circumference the threaded portion provided for closing (see FIG. 1).

Furthermore, it can be seen in FIG. 1 that the two parts 5*a* and 5*b* of the closure member, or in the case of a multi-part design, corresponding areas of the applicator arms 3*a*, 3*b*, are preferably configured in such a way that they form a collar 13*a* or 13*b*, which is sealingly pressed against the corresponding collar 14 of the wiper 15 under the influence of the force applied by the threaded portion, which is to be described in more detail later. If required, the collar 13*a* or 13*b* with its circumferential surface is able to form a centering means relative to an inner surface of the container-side closure member that surrounds it shortly before it reaches the final position.

Finally, the two parts 5*a* and 5*b* of the applicator-side closure member, or in the case of a multi-part design, corresponding areas of the applicator arms 3*a*, 3*b*, are preferably each provided with a centering appendage 16*a* or 16*b* on their side facing the cosmetics container. Together, they form a preferably slightly conical unit, or a unit that tapers towards the inside of the container, and are in that case configured in such a way that they ensure a preliminary centering of the applicator in the container neck or inside of the wiper, even before the threaded portion, or the threads that are to be described below, begin to grip, and preferably even before the centering effect of the circumferential surfaces of said collars 13*a* and 13*b* begins. In this manner, the threaded portion or the threads can easily be made to "grip" without taking particular care.

The two parts 5*a* and 5*b* forming the applicator-side closure member, as was already mentioned above, are interconnected by an inventive spring member 6. Preferably, the spring member 6 is integrally injection-molded onto the two parts 5*a* and 5*b*.

Figure 7:
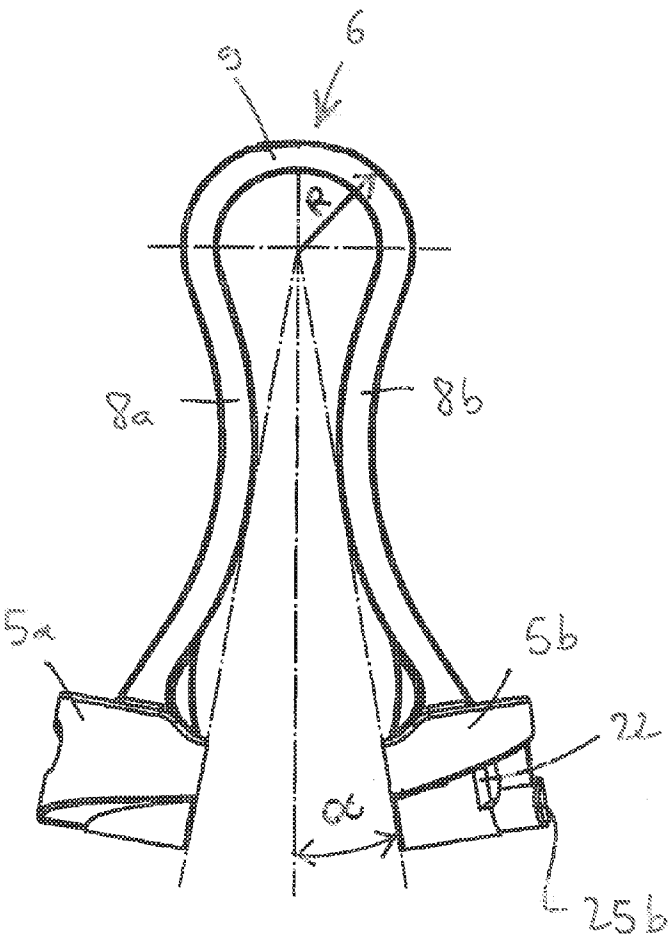
FIG. 7 shows a detail from the previous Figures, namely the two parts of the applicator-side closure member and the spring member injection-molded onto it.

The part consisting of these three components, which as a whole can also be referred to as a handle member, is injection-molded in a position that corresponds to an open position of the applicator and which is shown by FIG. 7. For the opening angle $\alpha$ shown in this FIG. 7 between the imaginary central axis and the tangent to the parts 5*a* or 5*b*, it is provided that the following equation preferably should apply to it: $5° \leq \alpha \leq 17.5°$ and ideally $7.5° \leq \alpha \leq 12.5°$.

As can be seen in the FIGS. 1 to 8, and best in FIGS. 3 and 6 to 8, the spring member 6 consists of two handle sections 8*a* and 8*b* which are (preferably) concavely curved towards the outer face of the spring member that, as intended, comes into contact with the fingers of the user. In turn, they are connected to each other via a ring portion 9 of the spring member. The ring portion preferably has a radius of curvature R for which the following applies: R≥2 mm and ideally R≥3 mm, see FIG. 7. This radius of curvature is preferably as large as defined just now over an angle $\gamma$ of more than 180°, see FIG. 8.

The ring portion 9 is responsible for the predominant part of the spring action because the predominant part of the elastic deformation required for bringing the two applicator arms 3*a* and 3*b* to rest against each other takes place in the area of the ring portion.

Figure 3:
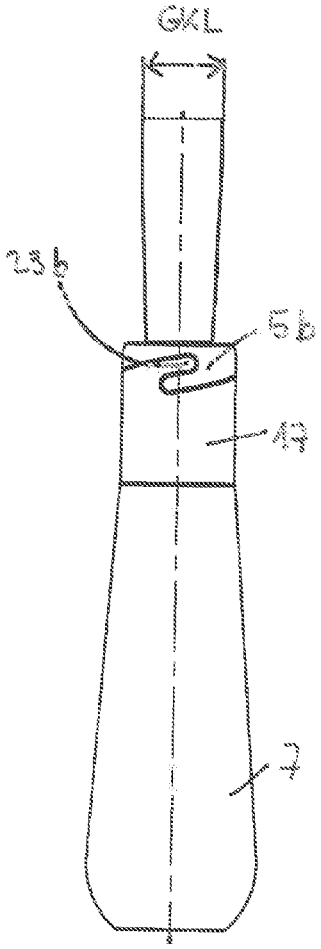
FIG. 3 shows a side view of the cosmetics unit shown by FIG. 1.
Figure 8:
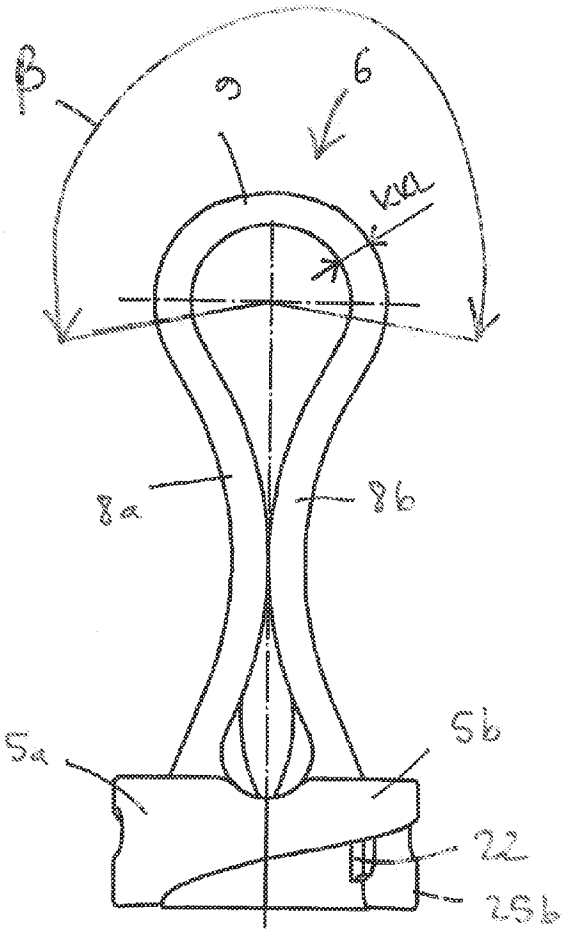
FIG. 8 shows the detail shown by FIG. 7, but in the completely closed state in which the two parts of the applicator-side closure member rest against each other and form a unitary applicator-side closure member.

The spring member 6 preferably has a rectangular cross section, the small edge length KKL of which is ≥0.8 mm and preferably ≥1 mm, see FIG. 8. The small edge length is preferably constant over the entire spring member 6. The great edge length GKL approximately corresponds to the diameter of the neck of the cosmetics container of the cosmetics unit according to the invention, see FIG. 3. Preferably, the great edge length is selected so as to be greatest in the area of the ring portion 9 and so as to decrease along the handle sections 8*a* and 8*b* towards the first and second part of the applicator-side closure member, as illustrated by FIG. 3. In many cases, said decrease is comparatively small and is less than 20%.

On the one hand, the spring member according to the invention applies a large spring bias over a large spring deflection which considerably facilitates the handling of the applicator and therefore exhibits a considerably different behavior from an only locally provided film hinge. Given a correct dimensioning of the spring member configured according to the invention (which can be easily determined for the respective specific case of application by a few experiments that are customary in the field), this spring bias is so large that the applicator arms 3*a*, 3*b* always move away from each other automatically once the pressure of the fingers abates. This is also the case if the bristles of the applicator elements 4*a* and 4*b* have been pushed into one another intensively before and if the bristles in the contact area are still charged with a cosmetic mass that exhibits a strong adhesive action.

In addition, the spring member, which is very wide in the direction of GKL, guides the two arms of the applicator very precisely relative to one another. The width GKL is selected in such a way that the applicator elements 4*a* and 4*b* come into contact with each other at exactly the same places again and again when the two applicator arms are being fully compressed, for example into the position shown by FIG. 1. In any case, this applies as long as the applicator is compressed as intended, without any excessive forces acting, which the unbiased user would not exert anyway. This precision becomes very important especially when the applicator elements 4*a* and 4*b* are covered with injection-molded bristles. In that case, it can be ensured, due to the precise guidance of the applicator arms relative to one another, that the bristles of the two applicator elements substantially mesh in a defined manner—i.e. stay predominantly straight instead of abutting one another in an undefined way, thus being bent in large numbers.

Thus, the focus can now be directed to the quick closure which contributes to the invention and which this first exemplary embodiment uses.

Figure 4:
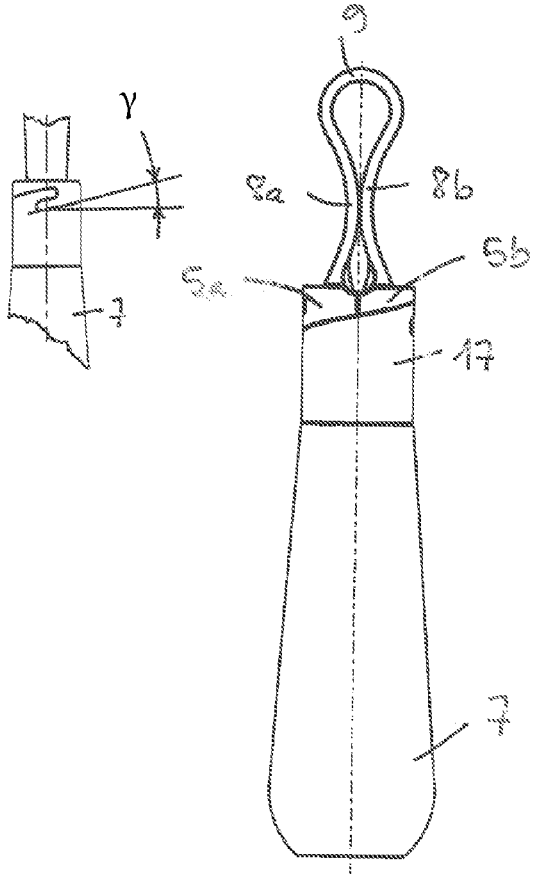
FIG. 4 shows a front view of the cosmetics unit shown by FIG. 1 in the closed state.
Figure 5:
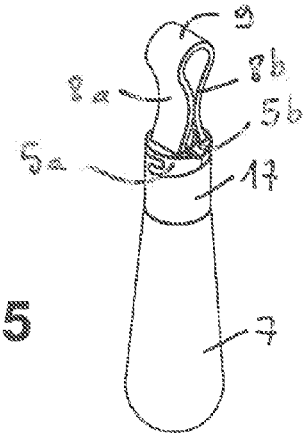
FIG. 5 shows a perspective view, at an angle from above, of the cosmetics unit according to the FIGS. 1 to 4.
Figure 6:
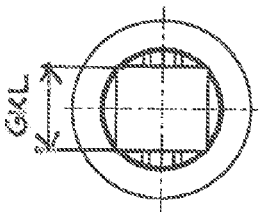
FIG. 6 shows a top view of the cosmetics unit according to the FIGS. 1 to 5 in the closed state.

As can best be seen in FIGS. 3 and 4, the quick closure consists of the two-part (parts 5*a* and 5*b*) applicator-side closure member, which was already mentioned several times, and a container-side closure member 17.

Figure 12:
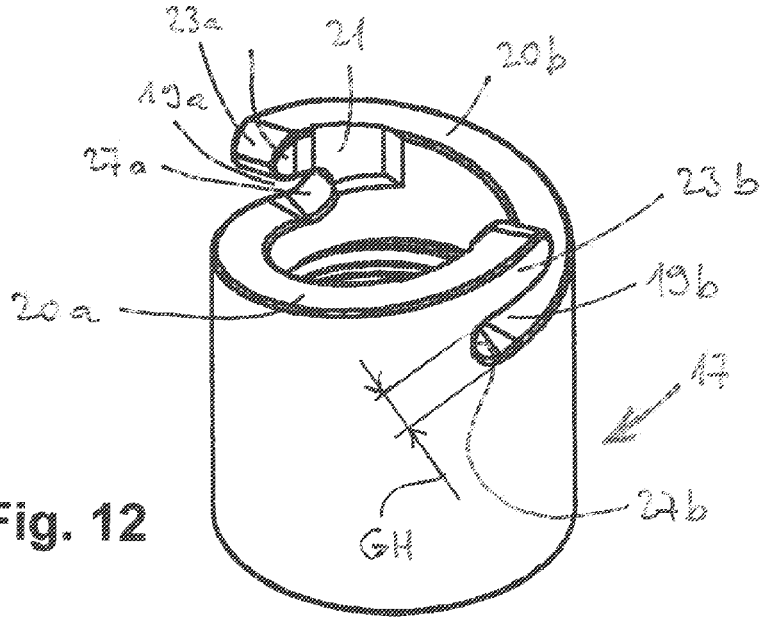
FIGS. 12 to 16 show the container-side closure member in various views, which uses the first embodiment according to the FIGS. 1 to 6.
Figure 16:
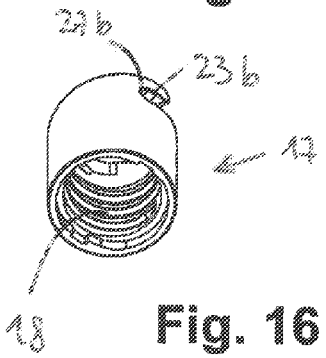

The container-side closure member 17 shown, for example, by FIGS. 3, 4 and 12 is generally a multi-part (e.g. screwed on) or integral component of the cosmetics container 7. In the present case, the closure member 17 is screwed on to the neck of the cosmetics container 7 with a threaded portion 18 of the conventional type; however, it may also be latched thereto. If such a threaded portion 18 is used, latching means for latching into corresponding latching means of the cosmetics container 7 are generally provided in the vicinity of the threaded portion or in the threaded portion itself (see for example FIGS. 16, 17), where a corresponding latching recess is located in the lowermost edge of the threaded portion, approximately in the position "7 o'clock", which cooperates with a latching lug of the cosmetics container. An inadvertent detachment of the container-side closure member 17 is thus avoided.

The exact functional principle of the quick closure, which makes up a part of the invention, can best be described with reference to the FIG. 12. In this specific exemplary embodiment, FIG. 12 shows the container-side closure member 17.

The crucial point is that at least one of the two closure members, as provided by the invention, has to be provided with a multi-start steep-pitch threaded portion designed in such a way that the two closure members can be brought from a position in which the threads of the steep-pitch threaded portion begin to grip for the first time into a fully closed position, with less than a ⅜ turn relative to one another. Preferably, the design is such that the closing process just described can take place with less than a ¼ turn or ideally even with less than ⅛ turn.

The multi-start threaded portion, which in the present case is a double-start threaded portion formed of the threads 19*a* and 19*b*, is clearly recognizable in FIG. 12. The term thread denotes the area which is closed on three sides, towards the top, towards the bottom and in one circumferential direction, and with which the closure member can therefore exert a force on the other closure member that acts in a closing manner. It can also be recognized clearly that each thread is preceded by a free screw surface 20*a* or 20*b* (the term "precedes" relates to the closing direction).

Figure 13:
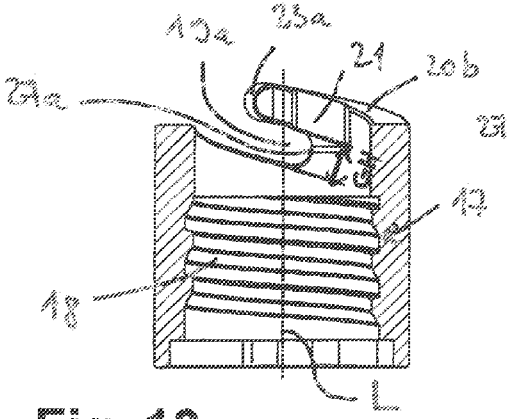
Figure 15:
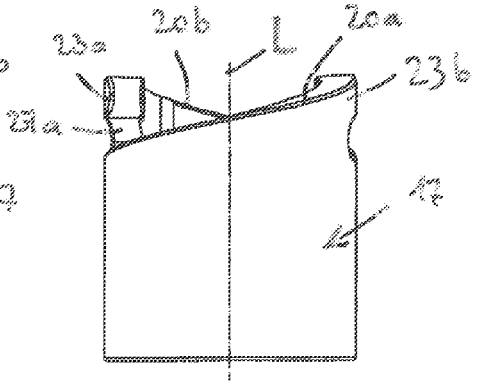
Figure 14:
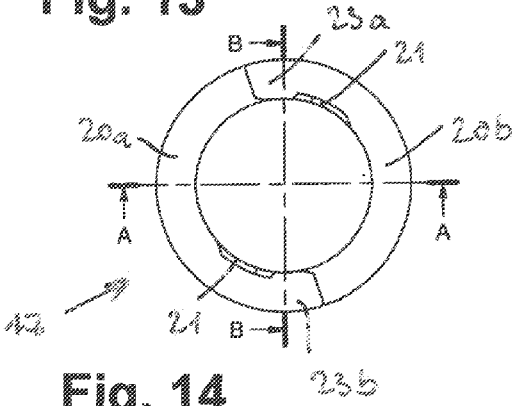

Ideally, each of these single threads has a pitch GH of at least 1.2 mm, better at least 1.5 mm, and ideally, at least 1.7 mm, see FIGS. 12 and 13, in which the pitch is respectively shown by a drawing.

The threaded portion is configured as a steep-pitch threaded portion, i.e. the lead angle γ (see detailed view for FIGS. 3 and 4) of each of the threads is at least 5° relative to the horizontal, better even at least 7° to the horizontal. Ideally, at least 8° to the horizontal is selected. In this exemplary embodiment, the lead angle γ is about 9° to the horizontal.

As can also be seen clearly in FIG. 12, latching recesses 21, into which corresponding latching projections 22 (see FIGS. 7 to 11) of the other closure member are inserted once the closure members have reached their fully closed position relative to one another, are preferably provided directly in the area (of at least one thread) of the threads. These latching recesses 21 and the associated latching projections 22 form additional retaining means that retain the two closure members (5*a* and 5*b* on the one hand, and 17 on the other hand) in addition to the thread friction that is present anyway, in this case by positive fit.

The special feature of the threaded portion shown by FIG. 12 is that the threaded portion is incorporated into a hollow-cylinder section of the container-side closure member 17 in such a way that the free screw surfaces 20*a*, 20*b* form the narrow limiting surfaces at the end faces of the hollow-cylindrical sections and the two threads 19*a* and 19*b* completely penetrate the wall of the hollow-cylindrical section in the radial direction, i.e. respectively form a "window" in the wall of the hollow-cylindrical section, so to speak. This results in, respectively, a first tongue 23*a* and a second tongue 23*b* which respectively form a side wall of the respective thread 19*a* or 19*b* and which respectively are only attached unilaterally in the area of the end of the thread. In particular when the closure member is produced from a plastic and the tongues 23*a* and 23*b* are dimensioned not too thick, they behave like leaf spring elements as a result, i.e. the tongues 23*a* and 23*b* can be elastically bent outwards in the radial direction to a small extent without much force being applied. Preferably, this effect is used to make it considerably easier for the latching recesses 21 incorporated into the tongues to latch into the complementary latching projections 22—once the tongues 23*a* and 23*b* come into contact at their tips with the latching projections 22 during the screwing-on process, they yield in a radially outward direction and preferably spring back radially into their original position completely only when the latching projections 22 have been inserted into the latching recesses 21.

As can best be seen in FIG. 12, the free screw surfaces 20*a* and 20*b* respectively extend substantially over half the circumference of the closure member.

As can best be seen in the FIGS. 3 and 4, the two closure members 5*a*, 5*b* or 17 are each complementary to a double-start steep-pitch threaded portion consisting of one first thread each and one second thread each as well as one first free screw surface each and one second free screw surface each. As a rule, however, only one closure member will have tongues that are resilient whereas the "tongues" of the other closure member are rigid. This is due to the fact that the steep-pitch threaded portion is incorporated into a sleeve section only in one closure member, whereas it is generally incorporated into a massive cylinder section in the other closure member, so that the "tongues" are attached at their radially inward side also in this case, which makes them very rigid of course, so that they form "solid sections".

Figure 9:
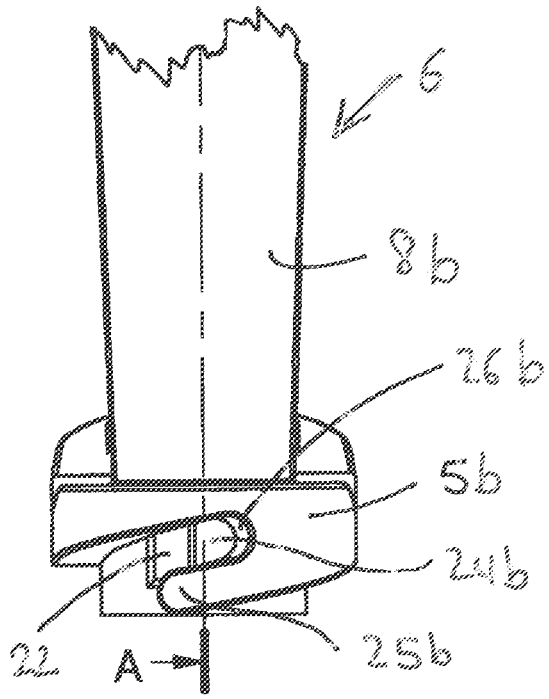
FIGS. 9 to 11 show the detailed view already shown by FIG. 7 from different viewing angles.
Figure 10:
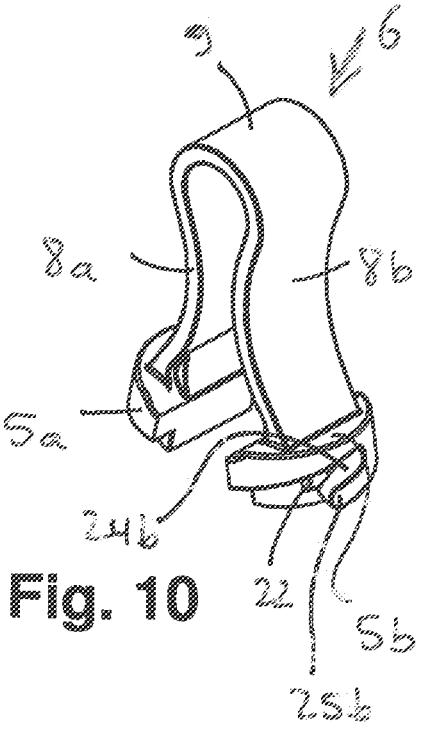

It can be seen very well in FIGS. 9 to 11 that this complementary applicator-side closure member consisting of the parts 5*a* and 5*b* preferably comprises a first thread and a second thread, preferably in such a way that one thread is associated completely to the one part and the other thread is associated completely to the other part.

It should be noted that the solid sections marked with the reference numerals 25*a* and 25*b* are substantially rigid both in the radial direction as well as in the direction of the longitudinal axis L; in this, they differ from the tongues 23*a* and 23*b* from FIG. 12, even if they look rather similar to them in other respects.

As can be readily seen in the Figures, the steep-pitch threaded portion in the present case is designed in such a way in the exemplary embodiments that it extends into the visible outer surface of the cosmetics unit in the finished cosmetics unit. Such a design not only has a certain aesthetic appeal, but also considerably simplifies operation—due to the fact that the user always sees the threaded portion, she will as a rule automatically place the two closure members onto one another during the closing process in such a way that she can bring the closure members into their closed position with an efficient rotary movement that is as short as possible.

Moreover, the steep-pitch threaded portion in this exemplary embodiment is designed in such a way that the two closure members 5*a*, 5*b*, on the one hand, and 17, on the other hand, form a uniform body with a continuously smooth visible outer surface, even though the steep-pitch threaded portions extend into the visible outer surface (see FIGS. 3 and 4). Such a design is not only very appealing aesthetically, but also makes sense from a hygienic standpoint—if some of the cosmetic mass should have deposited into the area of the threaded portion, it is relatively easy to wipe off in the case of such a design.

Moreover, it should be noted that the threads 23*a* and 23*b* in the exemplary embodiments shown here have a pronounced thread end which serves as a defined stop 26*a* or 26*b*, which is in fact reached during the closing process. This leads to the cosmetics applicator always coming to rest in the same final position—which is not the case in the known cosmetics applicators which were screwed on using a fine threaded portion that permits a more or less strong screw-on process, so that the cosmetics applicator comes to rest in different positions, depending on how strongly it was screwed shut.

It must be remarked that the spring member, which in many cases contributes considerably to the invention and which was already described in detail, is very advantageous precisely because it offers an increased torsional rigidity due to its special design. This enables the user to resolutely rotate the spring member without taking any particular care, in order to screw the applicator tightly onto the cosmetics container and optionally also to latch it there. This plays a role particularly if a chambered wiper of the type described below is used at the same time, which during the process of screwing the applicator shut has to be co-rotated completely or partially, possibly even against the resistance of the cosmetic, which sticks to the sliding areas in a certain way.

The first exemplary embodiment of the cosmetics unit according to the invention described so far uses a wiper of the known kind as it is used also in those innumerable cosmetics applicators that have only a single stem with a single cosmetics or mascara brush attached to its end.

Since such a standard wiper is in many cases only capable of providing a wiping result of limited use in the case of dual arm cosmetics applicators, it is provided according to the invention to preferably pair the dual arm applicator with a wiper that is specifically adapted to it.

Figure 19:
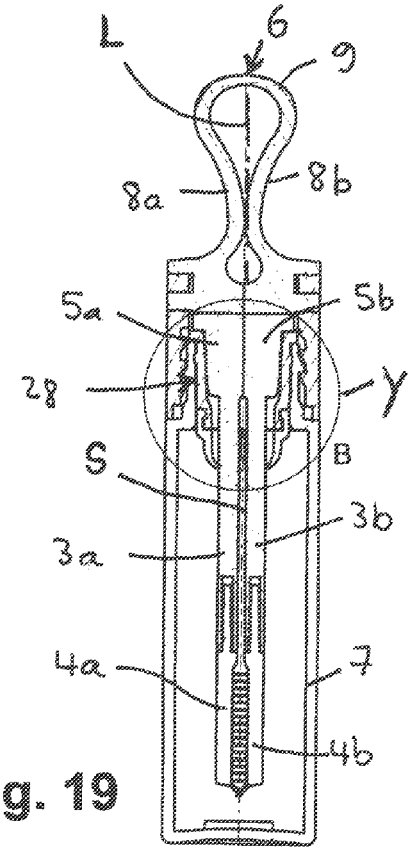
FIG. 19 shows a variant of the first exemplary embodiment of the cosmetics unit according to the invention.
Figure 20:
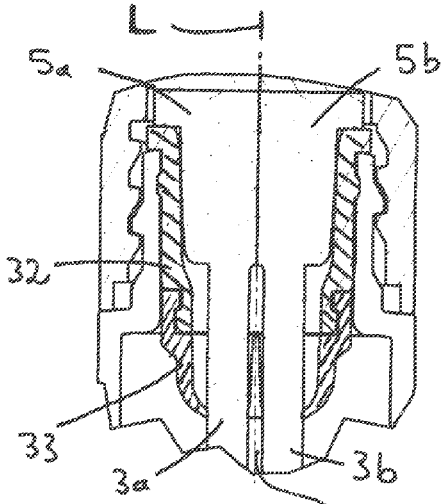
FIG. 20 shows a view of a detail from FIG. 19 with the area marked by the letter Y.

FIG. 19 illustrates this, together with the enlarged detail from FIG. 19 shown by FIG. 20. The cosmetics unit shown by FIG. 19 and its cosmetics applicator shown by FIG. 19 match the exemplary embodiment just described entirely. Therefore, the statements above also apply in their entirety to the variant of the first exemplary embodiment shown by FIG. 19, which is to be explained now—with the sole exception that the two applicator arms 3*a* and 3*b* do not rest against each other even if the spring member 6 is maximally compressed. Instead, they are designed in such a way that a slit S remains free also in the fully compressed state, see FIG. 19.

As can be seen in FIG. 20 et seqq., the wiper 28, which if required constitutes a substantial part of the invention, comprises a substantially sleeve-shaped wiper body 29, i.e. a wiper body 29 that substantially has the shape of a "tube", which as a rule has a circular cross section. The inside of the wiper 28, which seen in the direction along the longitudinal axis L is completely hollow, forms a passage 30 through which a cosmetics applicator 2 can be inserted into the cosmetics container 7 from the outside and which the application elements 4*a* and 4*b* pass again when they are withdrawn from the cosmetics container 7, see FIGS. 19 and 21.

Figure 21:
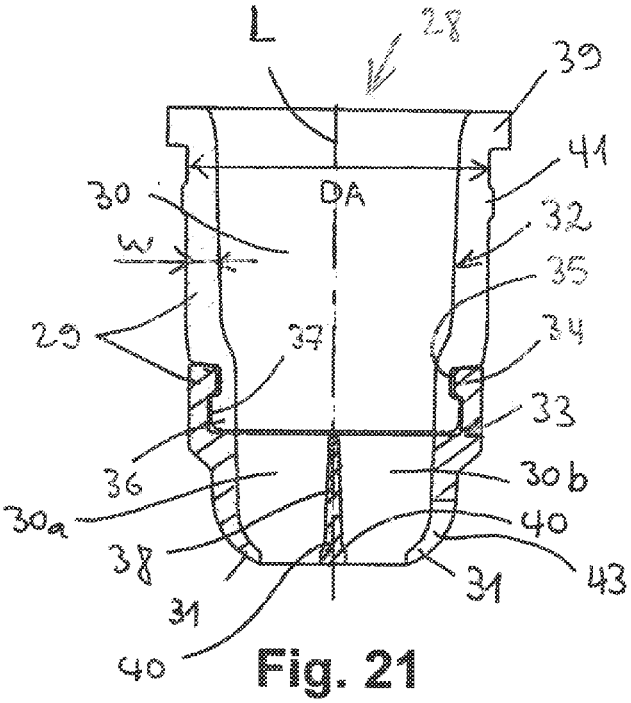
FIGS. 21 to 24 show various views of the wiper according to the invention used in the cosmetics unit according to FIG. 19.
Figure 23:
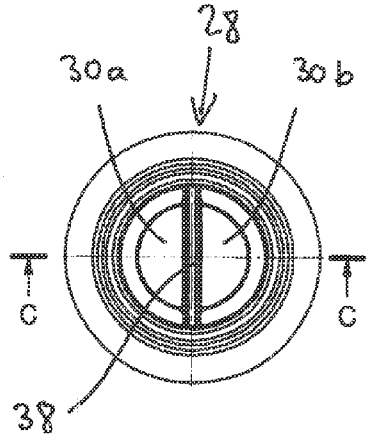

As can best be seen in FIG. 21, the wiper 28 in this exemplary embodiment is divided into a first wiper part 32 and a second wiper part 33, which together form a wiper body 29. The two wiper parts 32, 33 are latched to each other in a positive fit and, when new, can be easily rotated relative to one another. The positive-fit elements 34, 35, 36, and 37 are designed or provided with a tolerance in such a way that the second wiper part 33, however, can be rotated not only when it is new, but remains rotatable over the entire intended life of the wiper, which is most frequently designed as a disposable part. For this purpose, each of the wiper parts 32, 33 is configured with a latching lug 34, 36 and at the same time with a latching groove 35, 37, so that each wiper part 32, 33 is latched with its own latching lug to the other wiper part.

Figure 22:
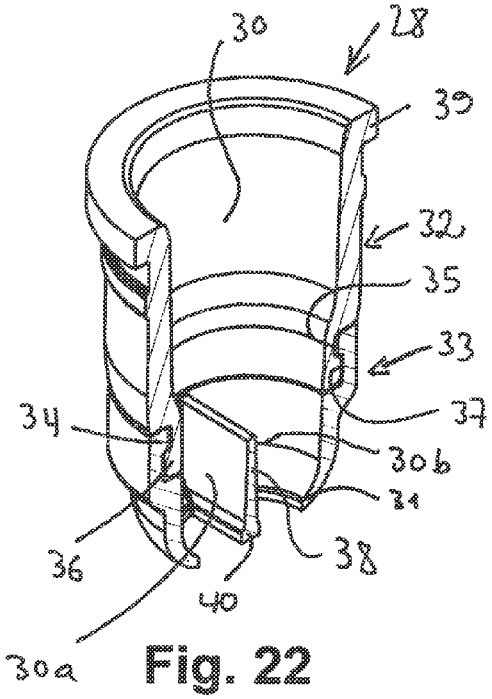
Figure 24:
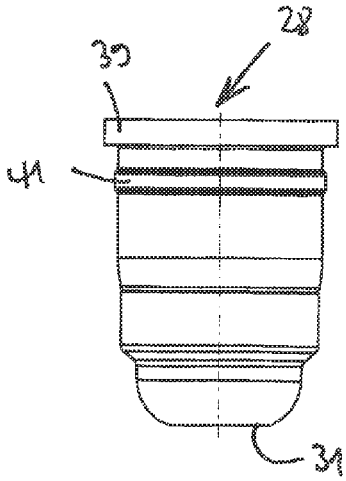
Figure 25:
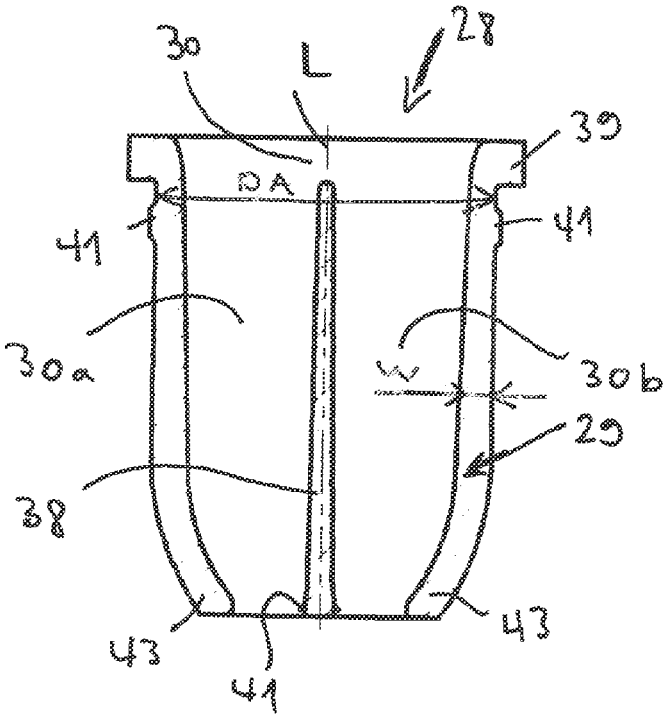
FIGS. 25 to 28 show various views of the wiper used in the cosmetics unit according to the second exemplary embodiment shown by FIG. 17.
Figure 27:
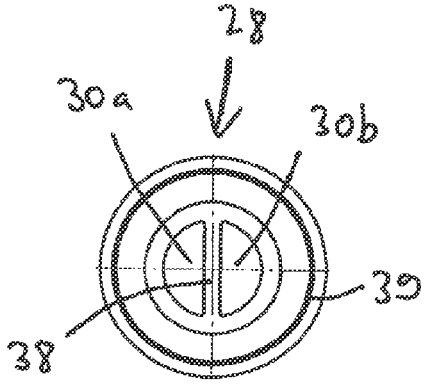
Figure 26:
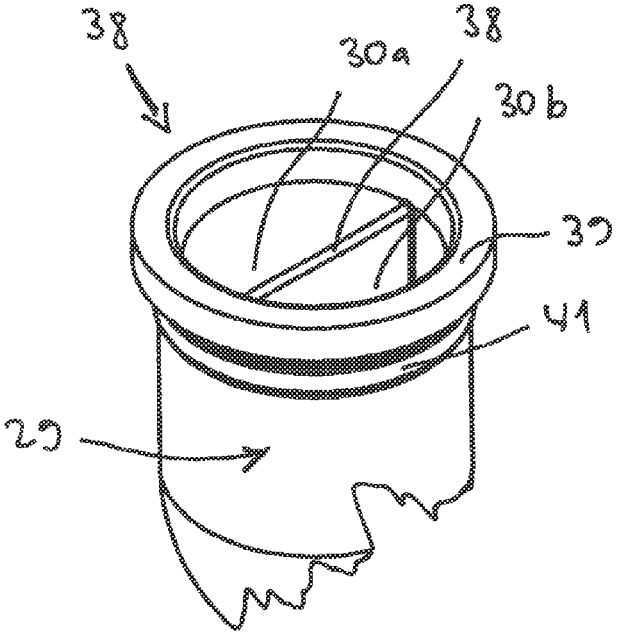
Figure 28:
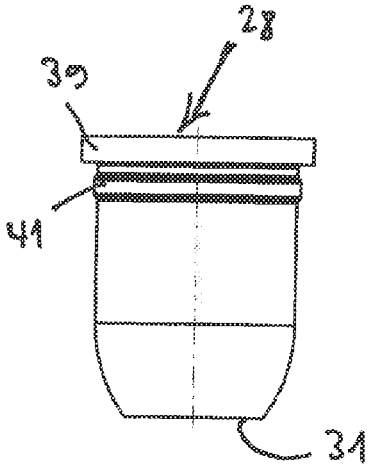

The first wiper part 32 is non-rotatably fixed to the neck portion of the cosmetics container 7 if it has been mounted as intended. The first wiper part 32 is not provided with a dividing wall, but forms a single uniform passage 30 through which both applicator arms 3*a*, 3*b* extend together. Only the second, movable wiper part 33 is equipped with a dividing wall 38. The dividing wall 38 extends preferably at least substantially over the entire length of the movable second wiper part 33 in the direction of the longitudinal axis L and divides the passage 30 into two passage portions 30*a* and 30*b*. At least, however, the dividing wall 38 extends over at least half the length of the second wiper part 33 in the direction of the longitudinal axis L. The thickened portion 40 that the dividing wall 38 of the second wiper part 33 comprises in the area in which the inwardly retracted part of the wiper body 29 forms the wiper lip 31 can be discerned rather well in FIGS. 21 and 22.

As can be seen in FIG. 19, the first applicator arm 3*a* reaches through the first passage portion 30*a* of the wiper 28, and the second applicator arm 3*b* reaches through the second passage portion 30*b*. The dividing wall 38 has nestled between the two applicator arms 3*a* and 3*b*, i.e. in the slit S which remains as intended between the two applicator arms 3*a* and 3*b*. Because of this, the applicator arms in particular are separately wiped off all around when the applicator is withdrawn, which greatly reduces the amount of the cosmetic mass which inadvertently adheres to the applicator arm and is dragged out of the cosmetics container together with it.

Due to the fact that the second wiper part 33 is rotatably fixed on the fixed first wiper part 32, it becomes possible to associate one of the wipers with a dividing wall, which work particularly well, with the cosmetics applicator 2, and without having to dispense with fixing the cosmetics applicator reliably and always tightly on the cosmetics container using a threaded portion. This particularly applies to the use of the above described threaded portion according to the invention, with which the applicator can be fixed on the cosmetics container with a short rotary movement, so that the two components of the applicator are not subjected to relative movements that are too large.

Figure 17:
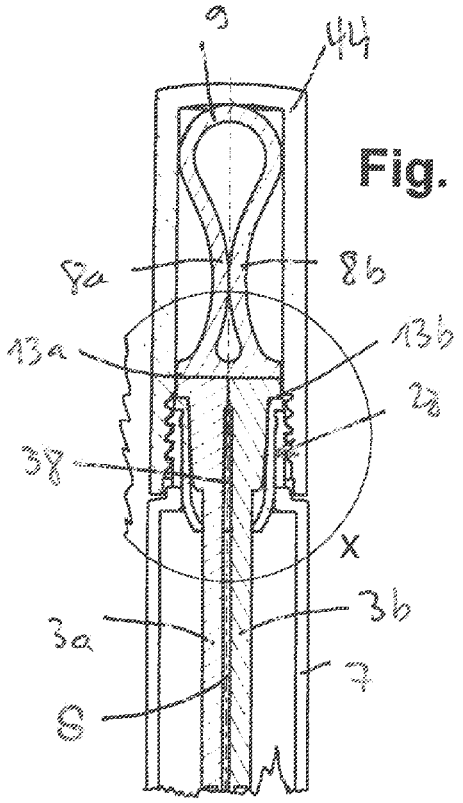
FIG. 17 shows a second exemplary embodiment of the cosmetics unit according to the invention.
Figure 18:
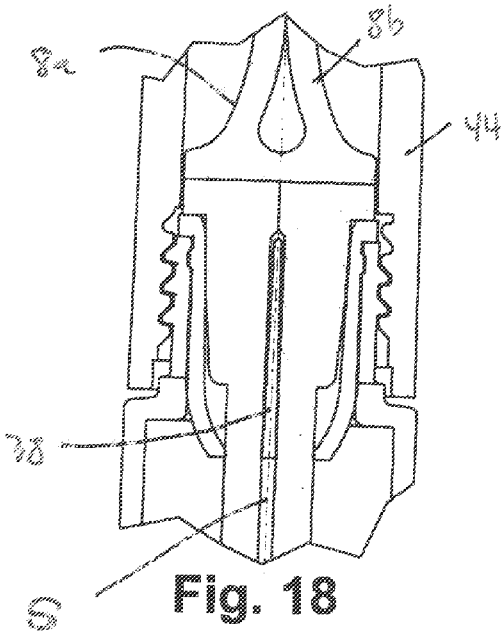
FIG. 18 shows the detail marked with X in FIG. 17.

FIG. 17 and the associated FIG. 18, which is an enlarged detail from FIG. 17, show a second exemplary embodiment of the invention.

This exemplary embodiment differs from the first exemplary embodiment and the modification thereof that was just described in that the cosmetics applicator itself does not carry a threaded portion with which it is screwed on to the cosmetics container. However, it corresponds to the first exemplary embodiment to the extent that it comprises exactly the same spring member 6, so that the statements in this regard also apply to this applicator.

Apart from the lacking threaded portion, the parts 5*a* and 5*b* of the applicator-side closure member and the applicator arms 3*a* and 3*b* as well as the applicators attached thereto correspond to those of the first exemplary embodiment. Therefore, the statements made above with regard to the first exemplary embodiments in this regard also apply to this second exemplary embodiment.

In this second exemplary embodiment, a separate closure cap 44 which carries a threaded portion and is screwed on to the container neck belongs to the cosmetics unit. Said threaded portion can be a conventional threaded portion as is shown by FIG. 17. Preferably, however, the cap is equipped with the same threaded portion as it was described above as being in accordance with the invention. In that case, the statements made above with respect to the threaded portion apply mutatis mutandis to the threaded portion formed in the closure cap 44.

In any case, the closure cap 44 and the spring member 6 of the applicator are designed in such a way that the closure cap presses with its inner face on the spring member and in this way sealingly presses the collar 13*a*, 13*b* of the container-side closure member against the collar 39 of the wiper.

The wiper is a special feature also in this second exemplary embodiment. The wiper used in the context of this second exemplary embodiment is illustrated by the FIGS. 25 to 28.

The statements made above with regard to FIGS. 21 to 24 apply in their entirety to this wiper, the sole exception being that the wiper is configured as a single part and is therefore fixed completely in the container neck.

In this second exemplary embodiment, the dividing wall 38 extends over at least 6/7 of the length of the wiper 28 in the direction of the longitudinal axis L. This is particularly advantageous. Generally, it can be said, the length of the dividing wall 38 is at least one-fourth of the length of the wiper 1 in the direction of the longitudinal axis L, better still half of the length of the wiper 1 in this direction.

Finally, it must be stated that the following applies for wipers which may possibly be used within the context of the invention, regardless of whether it is of a single-part or two-part design:

The wiper body 29 or its two wiper parts 32, 33 are thin-walled. The wall thickness W of the aforementioned parts is preferably at least 0.25 mm, better at least 0.4 mm, and maximally 1.5 mm. The wiper body 29 generally consists of a plastic or an elastomer or even a rubber-elastic material.

The wiper body 29 can be configured to consist of a single component, i.e. consist of only a single material. In that case, it is particularly simple to produce, which is of great importance in the case of a disposable part. For more sophisticated applications, the wiper body 29 can be given a multi-component configuration and consist, for example, of a basic element consisting of a hard plastic to which an area consisting of a softer or even rubber-elastic material is injection-molded which forms the collar of the wiper body and/or the wiper lip 31.

The wiper body 29 preferably tapers towards the end thereof inside the container and thus forms a wiper lip 31.

The wiper 28 is provided for mounting in a preferably circular container neck and is configured accordingly. On its side facing away from the inside of the container, it bears a collar 39 with which it is supported against the bottle's neck or the upper end of the container in which it is mounted. It is thus ensured that the wiper 28 is not pressed into the cosmetics container 7 by the forces produced when the applicator 2 is pushed in.

On the side of the collar 39 pointing inside the container, the wiper body 29 is provided with a latching means, which in this case is configured in the form of a latching bead 41. The latter latches into a corresponding latching groove 21, 22 of the container neck if the wiper 28 is mounted as intended. In this exemplary embodiment, the latching bead 41 and the external diameter DA of the wiper body 29 underneath the collar 39 are configured in such a way that the wiper 28 or first wiper part 32 are non-rotatably retained on the bottle's neck after having been mounted as intended.

The wiper lip 31 is given the required elasticity either by the material of the wiper 28 alone, and/or also by the configuration in the area of the wiper lip 31, so that it is able to resiliently abut against the stem to be wiped off and the applicator 2 to be wiped off. For example, a suitable configuration may be to provide the outer wall of the wiper body 29 with slits 43 in the area of the wiper lip 31 (see FIG. 21). In that case, such slits 43 divide the wiper body 29 into a row of individual segments whose elasticity is far higher than that of the continuous wiper body 29. The slits 43 can lie in a plane which intersects the longitudinal axis L of the wiper 28 or in a plane that extends skewed to the longitudinal axis L. In many cases it is particularly advantageous if the slits 43 are not configured in a rectilinear manner, but lie on a helical line, for example.

The dividing wall 38 is preferably planar and preferably at least mainly, or most frequently even substantially, smooth. Generally, it is formed by a continuous, non-perforated wall and injection-molded integrally together with the rest of the wiper body 29 or the second wiper part 33 in a single process step. In that case, it preferably consists of the same material as the rest of the wiper body 29.

Preferably, the dividing wall 38 tapers towards the outside end of the wiper 28, relative to the insertion as intended of the end of the wiper 28 on the inside of the container. It is expedient that the dividing wall 38 has its greatest strength at the level of the wiper lip 31, because there, it should abut the area of the applicator 2 to be wiped off by it in the most intimate manner.

In this case, it is particularly advantageous if the thickness of the dividing wall 38 is approximately 10-30% less than the wall thickness of the wiper body 29. That means that the wall thickness of the dividing wall 38 should be between 0.17 mm, between at least 0.3 mm, and maximally 1.5 mm, better maximally 1.2 mm. Preferably, the dividing wall 38 is configured as a membrane. This is readily possible because the dividing wall 38 is generally connected to the wiper body along the entire length of its transition into the wiper body 29, and is thereby held "folded open" by it. In any case, it is beneficial if the dividing wall is configured so thin that the two applicator arms and/or the two applicators rest against one another completely when they are in their "parking position" in the cosmetics container and nevertheless accommodate the dividing wall between themselves in this case.

In the present exemplary embodiment, the dividing wall 38 extends in a plane lying on the central line L. The passage 30 is thus divided into passage portions 30*a*, 30*b* of the same size.

As can be seen rather well in the FIGS. 17 to 28, the dividing wall 38, at the level of the wiper lip 31 or of the inside end of the wiper lip 31, has a certain thickened portion 40. This thickened portion 40 is preferably configured, on each side of the dividing wall 39, as a kind of strip that respectively extends in the direction perpendicular to the longitudinal axis L from one outer wall of the wiper body 29 to the other outer wall of the wiper body 29, see in particular FIG. 22, and similarly, FIG. 25.

The application behavior of the cosmetics unit according to the invention can be optimized to an even greater extent if it is designed as a mascara unit, if the fact is taken into account, when adapting the mascara mass, that this is a pincer-like applicator.

For example, it has proven particularly advantageous if the mascara unit according to the invention, which is designed in accordance with the statements above, is combined into a package together with a mascara mass whose ingredients are composed according to one of the following recipes.

The non-water-resistant mascara mass should preferably consist of the following ingredients:

Water approx. 20-60%
Waxes (e.g. beeswax, carnauba wax) 20-40%
Solvent (butylene glycol, propylene glycol) 5-20%
Thickener (xanthan gum, Keltrol) 0-5%

Emulsifiers 0-5%
Preservatives (phenoxyethanol, parabene) 0-2%
Pigments (iron oxides) 6-10%
Antioxidants (Covi-Ox) 0-1%
Polymer 0-5%

The water-resistant mascara mass to be used alternatively in the package should preferably consist of the following ingredients:

a) First alternative:
Water approx. 10-60%
Waxes (e.g. beeswax, carnauba wax) 20-40%
Solvent (butylene glycol, propylene glycol) 5-20%
Thickener (xanthan gum, Keltrol) 0-5%
Emulsifiers 0-5%
Preservatives (phenoxyethanol, parabene) 0-2%
Pigments (iron oxides) 6-10%
Antioxidants (Covi-Ox) 0-1%
Polymer 30-50% b) Second alternative:
Waxes: 20-40%
Isododecane 35-60%
Thickeners 0-5%
Pigments 6-10%
Preservatives 0-2%

The invention claimed is:

1. A cosmetics unit comprising:
a storage container; and
a mascara applicator with two applicator arms, wherein each applicator arm carries one applicator element and the two arms are interconnected by a spring member, wherein the mascara applicator has a bipartite applicator-side closure member for closing the storage container, a first part of the closure member is a component of a first applicator arm and a second part of the closure member is a component of a second applicator arm, and the closure member has a bipartite threaded portion, a first threaded-portion part of which is formed on the first part of the closure member, and a second threaded-portion part of which is formed on the second part of the closure member, and with which the closure member can be screwed on to a container-side closure member.

2. The cosmetics unit according to claim 1, wherein the threaded portion is a double-start threaded portion, whose first thread is formed entirely on the first part of the applicator-side closure member and whose second thread is formed entirely on the second part of the applicator-side closure member.

3. The cosmetics unit according to claim 1, wherein the threaded portion is a steep-pitch threaded portion with a thread lead of $\gamma \geq 5°$.

4. The cosmetics unit according to claim 1, wherein additional retaining devices are provided which hold the two closure members firmly against each other, once the closure members have reached their fully closed position, in addition to thread friction that is present anyway.

5. The cosmetics unit according to claim 3, wherein each thread of the steep-pitch threaded portion is preceded by a free screw surface that leads a respective counterpart of the threaded portion to a corresponding thread of the steep-pitch threaded portion when the closure members are brought in contact with each other by a movement along their longitudinal axis and are then rotated relative to each other in a closing direction.

6. A cosmetics unit comprising:
a storage container; and
a mascara applicator with two applicator arms, wherein each applicator arm carries one applicator element and the two arms are interconnected by a spring member, wherein the spring member comprises an annular spring member forming a distal end thereof, to which first and second spring portions are adjacent on both sides which are concavely curved towards the outside and whose opposing inner faces rest against each other and limit any further deformation of the annular spring member, when the two applicator arms rest against each other when the applicator is compressed.

7. The cosmetics unit according to claim 6, wherein a wall thickness and/or width of the spring member is substantially constant (+/−20%).

8. The cosmetics unit according to claim 6, wherein a width of the spring member, at least in an area of its annular spring member, is greater than or approximately identical to a clear diameter of an access opening of the storage container.

9. The cosmetics unit according to claim 1, wherein the cosmetics unit comprises a wiper having a substantially sleeve-shaped wiper body for mounting in a circular container neck, wherein a passage for the cosmetics applicator formed inside the wiper body is divided, at least in some areas, by a dividing wall into two passage portions extending next to one another, each of which is able to accommodate a part of the cosmetics applicator.

10. The cosmetics unit according to claim 9, wherein the wiper of the cosmetics unit is dimensioned in such a way, and comprises at least one latching element by which the wiper can be fixed in a direction of a longitudinal axis on a storage container in such a way, that the wiper is able to follow a rotary movement of the cosmetics applicator when the cosmetics unit is screwed open and shut and remains on the cosmetics container when the cosmetics applicator is withdrawn.

11. The cosmetics unit according to claim 9, wherein the wiper can follow a rotary movement of the cosmetics applicator when the cosmetics unit is screwed open and shut and remains on the cosmetics container when the cosmetics applicator is withdrawn, wherein the wiper comprises a collar for sealing an outside of the wiper against a cosmetics container and for sealing an inside of the wiper against a cosmetics container cap, and the collar is configured in such a way that the collar is pressed on by the cosmetics container cap, once the cosmetics cap reaches its full locking position, in such a way that the collar seals both against the cosmetics container as well as against a cosmetics container closure.

12. The cosmetics unit according to claim 9, wherein the wiper body of the cosmetics unit comprises a first part rotatably retained on a second part, wherein the first part is configured in such a way that it can be fixed on a storage container as intended and the second part comprises a wiper lip as well as said dividing wall, which divides the passage the second part offers for the cosmetics applicator into two passage portions extending next to one another.

13. A mascara system, comprising the cosmetics unit according to claim 1 and a mascara mass which comprises any combination of the following ingredients:
Water approx. 20-60%
Waxes 20-40%
Solvents 5-20%
Thickeners 0-5%
Emulsifiers 0-5%
Preservatives 0-2%
Pigments 6-10%
Antioxidants 0-1%
Polymer 0-5%.

14. A mascara system, comprising the cosmetics unit according to claim 1 and a mascara mass which comprises any combination of the following ingredients:

Water approx. 10-60%
Waxes 20-40%
Solvents 5-20%
Thickeners 0-5%
Emulsifiers 0-2%
Pigments 6-10%
Antioxidants 0-1%
Polymer 30-50%.

15. A mascara system, comprising the cosmetics unit according to claim 1 and a mascara mass which comprises any combination of the following ingredients:

Waxes 20-40%
Isododecane 35-60%
Thickeners 0-5%
Pigments 6-10%
Preservatives 0-2%.

16. The cosmetics unit according to claim 6, wherein the cosmetics unit comprises a wiper having a substantially sleeve-shaped wiper body for mounting in a circular container neck, wherein a passage for the cosmetics applicator formed inside the wiper body is divided, at least in some areas, by a dividing wall into two passage portions extending next to one another, each of which is able to accommodate a part of the cosmetics applicator.

17. The cosmetics unit according to claim 16, wherein the wiper of the cosmetics unit is dimensioned in such a way, and comprises at least one latching element by which the wiper can be fixed in a direction of a longitudinal axis on a storage container in such a way, that the wiper is able to follow a rotary movement of the cosmetics applicator when the cosmetics unit is screwed open and shut and remains on the cosmetics container when the cosmetics applicator is withdrawn.

18. The cosmetics unit according to claim 16, wherein the wiper can follow a rotary movement of the cosmetics applicator when the cosmetics unit is screwed open and shut and remains on the cosmetics container when the cosmetics applicator is withdrawn, wherein the wiper comprises a collar for sealing an outside of the wiper against a cosmetics container and for sealing an inside of the wiper against a cosmetics container cap, and the collar is configured in such a way that the collar is pressed on by the cosmetics container cap, once the cosmetics cap reaches its full locking position, in such a way that the collar seals both against the cosmetics container as well as against a cosmetics container closure.

19. The cosmetics unit according to claim 16, wherein the wiper body of the cosmetics unit comprises a first part rotatably retained on a second part, wherein the first part is configured in such a way that it can be fixed on a storage container as intended and the second part comprises a wiper lip as well as said dividing wall, which divides the passage the second part offers for the cosmetics applicator into two passage portions extending next to one another.

20. A mascara system, comprising the cosmetics unit according to claim 6 and a mascara mass which comprises any combination of the following ingredients:

Water approx. 20-60%
Waxes 20-40%
Solvents 5-20%
Thickeners 0-5%
Emulsifiers 0-5%
Preservatives 0-2%
Pigments 6-10%
Antioxidants 0-1%
Polymer 0-5%.

* * * * *